US005711524A

United States Patent [19]

Bauer et al.

[11] Patent Number: 5,711,524

[45] Date of Patent: Jan. 27, 1998

[54] GAME

[75] Inventors: Jean Bauer; Jean-Philippe Lebet, both of Canton of Neuchâtel, Switzerland

[73] Assignee: Trigam S.A., Switzerland

[21] Appl. No.: 728,830

[22] Filed: Oct. 10, 1996

[30] Foreign Application Priority Data

Oct. 19, 1995 [CH] Switzerland ..... 2966/95

[51] Int. Cl.[6] ..... A63F 9/12

[52] U.S. Cl. ..... 273/157 R; 273/153 P

[58] Field of Search ..... 273/153 P, 156, 273/157 R, 160

[56] References Cited

U.S. PATENT DOCUMENTS

| | | | |
|---|---|---|---|
| 1,709,660 | 4/1929 | De Bracht | 273/157 R |
| 3,993,313 | 11/1976 | Tillotson | 273/157 R |
| 4,133,538 | 1/1979 | Ambrose | 273/157 R |
| 4,257,609 | 3/1981 | Squibbs | 273/157 R |
| 5,407,201 | 4/1995 | Whitehurst | 273/156 |

*Primary Examiner*—Steven B. Wong

*Attorney, Agent, or Firm*—Silverman, Cass & Singer, Ltd.

[57] ABSTRACT

Regular rhombic dodecahedrons having faces with two aspects of two different kinds, each belonging to a same family, one by a bare surface, the other one by a shaded surface, are piled on a base having nests allowing those polyhedrons to be placed on top to build a composed pyramid. The general configuration of the visible faces of one kind and of the other kind will respond to specific rules of the game.

7 Claims, 3 Drawing Sheets

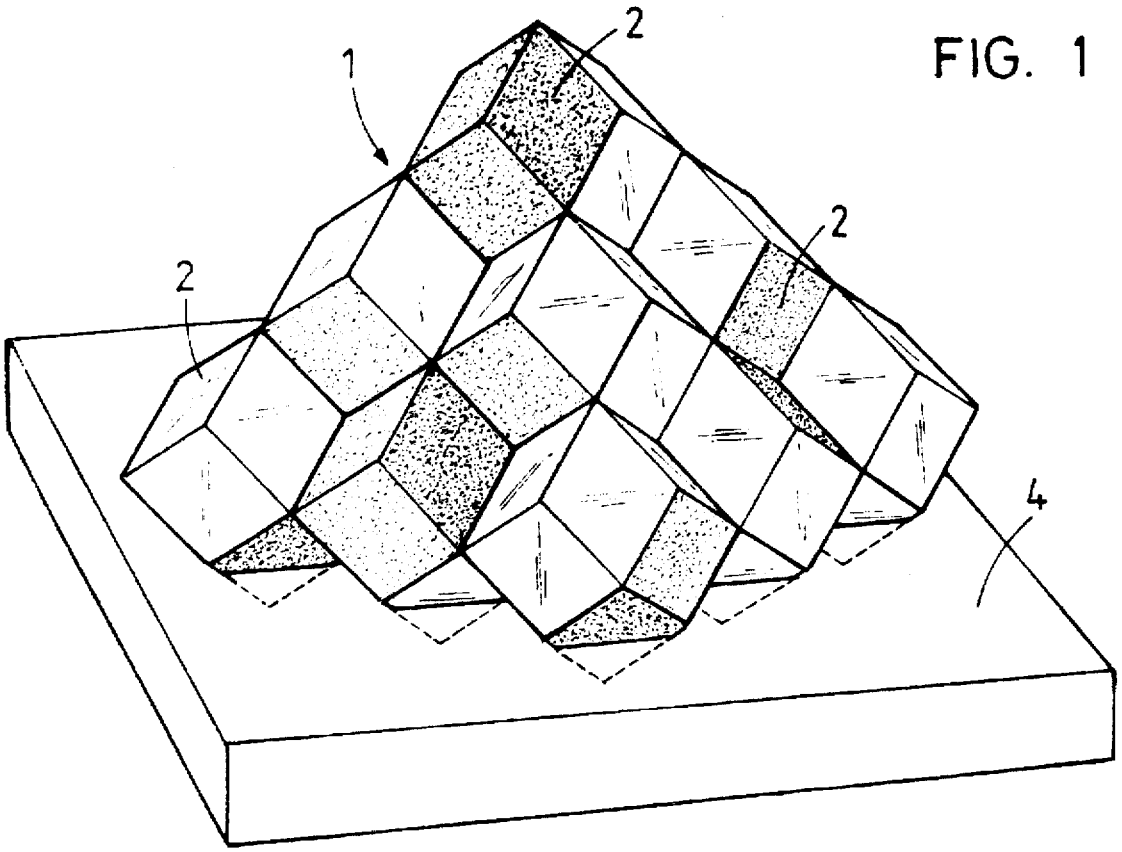
FIG. 1
FIG. 2
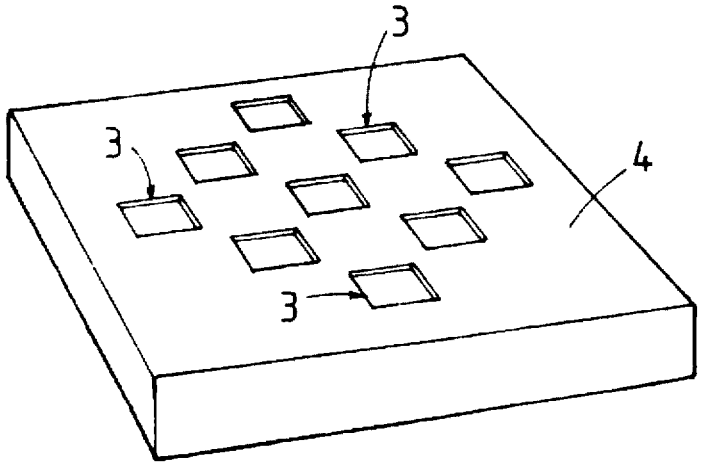

GAME

BACKGROUND OF THE INVENTION

Field of the Invention

This invention relates to a game.

SUMMARY OF THE INVENTION

The object of the present invention is to furnish a game being both recreative and didactic, developing particularly the player's reflection faculties and which, furthermore, allows to play with a same material according to game rules of different difficulties with regard to the age or the player's aptitude.

This object is achieved by the fact that the game comprises elementary polyhedrons, where a part has at least eight faces or more and where a part of these faces present in their appearance distinctive characters of at least two different kinds, the characters of one same kind being constituted in such a way as to indicate that they belong to a same family, and where it comprises at least one base with cavities receiving the said polyhedrons to be partially engaged therein, one of their apexes being turned downwards, these cavities being placed in order to allow the construction of a piling of said elementary polyhedrons in successive layers where the number of polyhedrons is decreasing towards the top, thus said piling constituting a composed polyhedron in which the relative position of the elementary polyhedrons' faces, according to their distinctive character, forms a configuration corresponding to at least one game rule.

The various features of the invention will be apparent from the following description, drawings and claims, the scope of the invention not being limited to the drawings themselves as the drawings are only for the purpose of illustrating ways in which the principles of the invention can be applied. Other embodiments of the invention utilizing the same or equivalent principles may be used and structural changes may be made as desired by those skilled in the art without departing from the present invention and the purview of the appended claims.

BRIEF DESCRIPTION OF THE DRAWINGS

FIG. 1 is a perspective view showing a first embodiment of the game.

FIG. 2 is a perspective view showing a component of the game.

DESCRIPTION OF THE PREFERRED EMBODIMENTS

Figure 3:
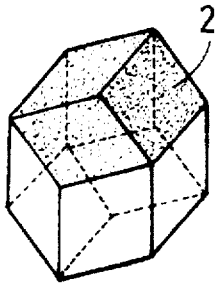
FIG. 3 is a perspective view of a component of the game.

The game represented in FIG. 1 comprises a complete piling 1 of elementary regular polyhedrons 2 constituted by rhombic dodecahedrons, whose number, per layer, is decreasing from the base to the top. The piling has a pyramidal shape. Its faces show hollow parts, due to the nature of the rhombic dodecahedrons 2.

In this piling the dodecahedrons 2 are placed "on tip", that is to say they have one of their apexes turned downwards. In order to be maintained in this position, with no piling disassembly, the dodecahedrons of the lowest layer are partially engaged in square shaped cavities 3 on a base 4, made in hard paper or plastic injected material, for example.

Figure 4:
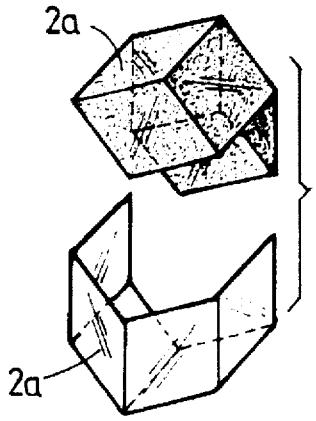
FIG. 4 is an exploded view of the game's component shown in FIG. 3.

The dodecahedrons 2, one of them being shown separately in FIG. 3, could have rounded tops. They will be made in hard paper, in plastic material or in wood. In a plastic execution, they will be preferably made of two pieces of identical shape 2*a*, shell shaped, assembled together as shown in FIG. 4. Each piece will have male and female elements, not shown on the drawing, intended to be fitted in order to assure their assembly.

The faces of the dodecahedrons 2 have an appearance of two kinds. The faces of one kind can be identical or different as long as they present distinctive characteristics indicating their belonging to a same "family"; such families can be characterized in different manners: color, even and uneven numbers, for instance, miscellaneous motifs linked by a common theme, different for each family, a.s.o. In the drawing, the faces of one kind have been represented in white and those of the other kind shadowed.

If the dodecahedrons are made in hard paper, the stamped sheet forming a component could be flat printed, that is to say, the stamped sheet being flat will be bent after printing to form the parts 2*a*.

The game will be provided with unique or with multiple rules which show to the player(s) how to place the elementary polyhedrons in order to realize the composed polyhedron, this in such a way that the faces of different appearance of the said elementary polyhedrons are shown in an imposed configuration or according to an imposed rule.

It is to be noticed that a same material will allow to follow several rules of different games.

Figure 5:
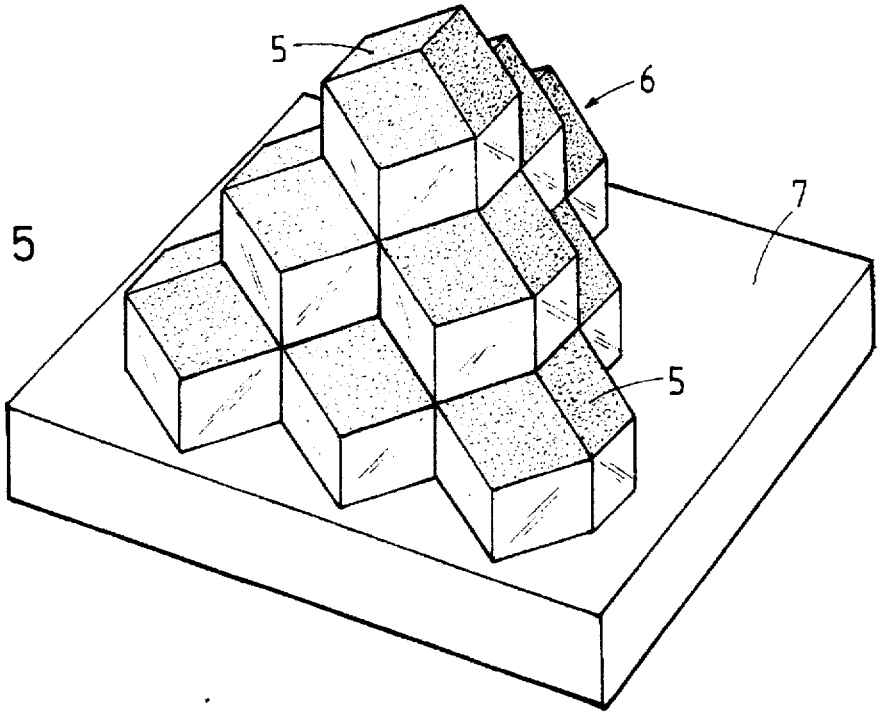
FIG. 5 is a perspective view of a modification of this game.
Figure 6:
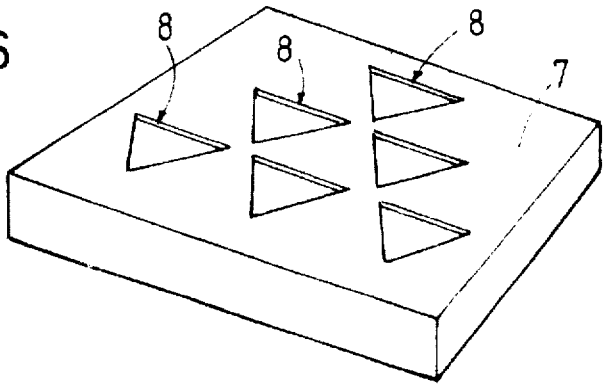
FIG. 6 is a perspective view of a detail of FIG. 5.

In the modification of FIGS. 5 and 6, the elementary polyhedrons are constituted by regular rhombic dodecahedrons 5 identical to these of the first embodiment, with two different face appearances, however piled in order to constitute a composed polyhedron 6 tetrahedral shaped. To this effect, the base, designated by 7, shows triangular shaped cavities 8.

As an example, the assembly of FIG. 5 has been realized in such a way that, on the left face of this figure, all the tilted faces of the elementary dodecahedrons 5 are of one kind, whereas all the vertical faces are of the second kind.

It is to be noted that, in the case the elementary polyhedrons are rhombic dodecahedrons, the appearance of their faces could be not only of two different kinds (half of their faces presenting the appearance of one kind and the other half the appearance of the other kind, as described and illustrated), but their faces could present three different appearances, a third presenting an appearance of the first kind, a third of the second kind and a third of the third kind.

In the case the elementary polyhedrons are rhombic dodecahedrons, their faces' appearances could be of three different kinds, a third of said faces presenting the appearance of each kind or a quarter of their faces presenting the appearance of the first kind, a quarter of a second kind and half of a third kind.

Still in the case of rhombic dodecahedrons, the appearances of their faces could be of four different kinds, a quarter of their faces presenting the appearance of each kind. Their faces could also have six different kinds of appearance, the sixth of their faces presenting an appearance of each kind.

Figure 7:
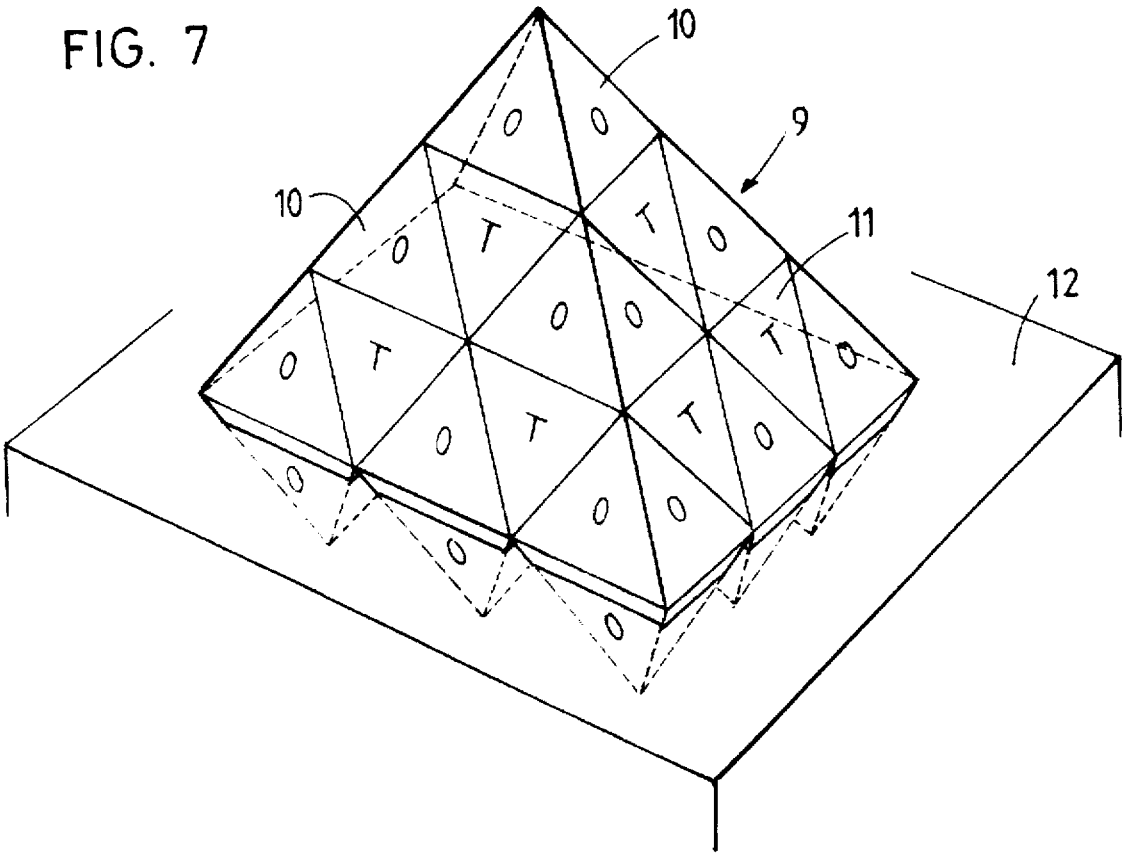
FIG. 7 is a perspective view showing a second embodiment of the game.
Figure 8:
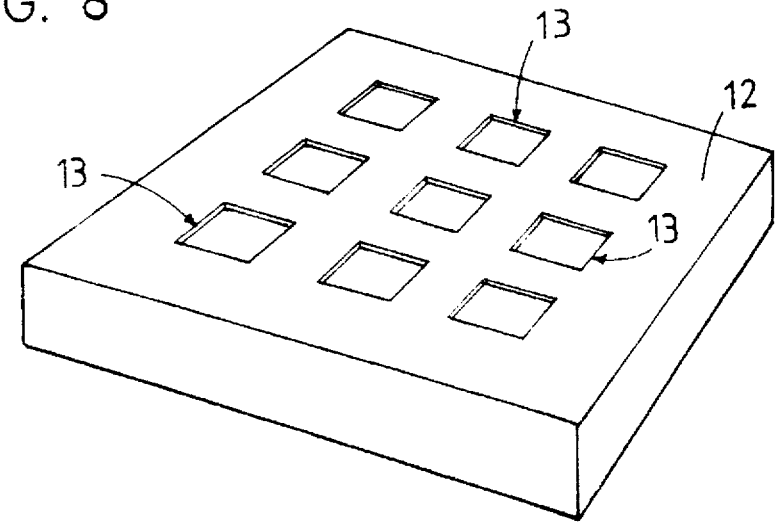
FIG. 8 is a perspective view of a part of the second embodiment.

In the embodiment of FIGS. 7 and 8, the piling, generally designated by 9 (FIG. 7), is formed by regular octahedrons 10 and regular tetrahedrons 11, identified by the characters "O" and "T". Such a piling composes a pyramid realized with the base 12 shown in FIG. 8, with square shaped cavities, designated by 13, which are arranged in a square configuration.

We claim:

1. A game comprising, a plurality of elementary polyhedrons, the faces of said elementary polyhedrons being of at least two different kinds, each face kind having a visually distinctive characteristic, at least two bases having a plurality of cavities for receiving said elementary polyhedrons to be partially engaged therein with one of the apexes of the elementary polyhedrons turned downwardly, the cavities being arranged to permit construction on each of the bases of a pile of said elementary polyhedrons in successive layers in which the number of elementary polyhedrons decreases towards the top of the pile, the pile of said polyhedrons forming a composed polyhedron in which the relative position of the faces of the elementary polyhedrons forms a selected configuration corresponding to at least two game rules, said elementary polyhedrons being regular rhombic dodecahedrons, the cavities in one of said bases being square shaped for a first game rule and the cavities in the other of said bases being triangular shaped for a second game rule.

2. A game as claimed in claim 1, wherein the elementary polyhedrons are regular rhombic dodecahedrons, in which the different kinds of their distinctive faces' characters are two, half of the said polyhedrons' faces presenting characters of each kind.

3. A game as claimed in claim 1, wherein the elementary polyhedrons are regular rhombic dodecahedrons, in which the different kinds of their distinctive faces' characters are three, a third of said polyhedrons' faces presenting characters of each kind.

4. A game as claimed in claim 1, wherein the elementary polyhedrons are rhombic dodecahedrons, in which the different kinds of their distinctive faces' characters are four, a quarter of said polyhedrons' faces presenting the appearance of one kind, a quarter of the second kind and a half of the third kind.

5. A game as claimed in claim 1, wherein the elementary polyhedrons are regular rhombic dodecahedrons, in which the different kinds of their distinctive faces' characters are four, a quarter of said polyhedrons' faces presenting characters of each kind.

6. A game as claimed in claim 1, wherein the elementary polyhedrons are regular rhombic dodecahedrons, in which the different kinds of their distinctive faces' characters are six, a sixth of said polyhedrons' faces presenting characters of each kind.

7. A game as claimed in claim 1, wherein the elementary polyhedrons are regular rhombic dodecahedrons, in which said dodecahedrons have their apexes rounded.

* * * * *